United States Patent [19]

Kuck et al.

[11] 4,337,125

[45] Jun. 29, 1982

[54] ELECTROCHEMICAL SYNTHESIS OF ORGANOPHOSPHORUS COMPOUNDS FROM THE ELEMENT

[75] Inventors: Mark A. Kuck, Upper Montclair, N.J.; Gary K. Miller, Port Chester, N.Y.

[73] Assignee: Stauffer Chemical Company, Westport, Conn.

[21] Appl. No.: 213,773

[22] Filed: Dec. 8, 1980

[51] Int. Cl.[3] ..... C25B 3/00; C25B 3/12

[52] U.S. Cl. ..... 204/59 R; 204/72

[58] Field of Search ..... 204/59 R, 72

[56] References Cited

U.S. PATENT DOCUMENTS

| | | | |
|---|---|---|---|
| 3,730,857 | 5/1973 | Tripp | 204/59 R |
| 3,730,864 | 5/1973 | Tarjanyi et al. | 204/149 |
| 4,250,000 | 2/1981 | Kuck et al. | 204/59 QM |

FOREIGN PATENT DOCUMENTS

| | | | |
|---|---|---|---|
| 2121732 | 3/1972 | Fed. Rep. of Germany | 204/59 R |

*Primary Examiner*—Howard S. Williams

*Attorney, Agent, or Firm*—Henry Z. Friedlander

[57] ABSTRACT

A process for the preparation of organophosphorus derivatives of organic hydroxyl or sulfhydryl compounds which includes the step of electrolyzing said organic hydroxyl or sulfhydryl compounds in an electrochemical cell having an anode comprising elemental phosphorus.

13 Claims, No Drawings

ELECTROCHEMICAL SYNTHESIS OF ORGANOPHOSPHORUS COMPOUNDS FROM THE ELEMENT

BACKGROUND OF THE INVENTION

This invention relates to organophosphorus compounds, especially organophosphates and organothiophosphates. More particularly, it relates to the electrochemical synthesis of organophosphates and organothiophosphates in compartmented or uncompartmented cells.

Neutral organic esters and thioesters of phosphoric acid have been synthesized in the past by the reaction of phosphurus trichloride and phosphorus oxychloride with alcohols, phenols, mercaptans, or thiophenols. More recently organic phosphates have been prepared by the reaction of phosphorus pentachloride with ethers, as disclosed in U.S. Pat. No. 2,407,279. Employing phosphorus halides to make organic phosphates or thiophosphates generates hydrogen halides as by-products, which are corrosive, difficult to handle, and troublesome to dispose of in an environmentally sound manner. The reaction of phosphorus pentoxide with organic hydroxyl or sulfhydryl compounds required high temperatures, often high pressure, and the maintenance of supplies of reactive chemicals in inventory.

Warshawsky, Tomilov, and Smirnow published in the *All-Union Journal of General Chemistry* 7, 598 (1962-USSR) a description of an electrochemical process for the synthesis of trialkyl phosphates by passing current between graphite electrodes in a cell containing alcoholic hydrogen chloride and a suspension of red phosphorus. Trimethyl, triethyl, tributyl and triamyl phosphates were made from the respective alcohols by this procedure.

Hettinger disclosed in U.S. Pat. No. 2,079,311 an electrochemical method for preparing tertiary phosphines using an anode of elemental phosphorus. Of the various allotropic forms of phosphorus, black was the preferred phosphorus electrode.

In *Electrochemical Technology* 45, 502–6 (1966) Barry and Tobias published studies of the anodic oxidation of white phosphorus. In these studies the authors disclose electrodes comprising phosphorus-mercury, phosphorus-silver, phosphorus-platinum, phosphorus-copper, phosphorus-nickel, phosphorus-tin, phosphorus-lead, phosphorus-iron, and amalgams of the above combinations. The preferred phosphorus anode contained graphite powder or silver amalgams.

White disclosed in U.S. Pat. No. 4,021,321 an indirect electrochemical oxidation of phosphorus in aqueous hydrogen halide and an immiscible nonaqueous solvent such as chloroform to produce phosphorus acid.

Dolan disclosed in U.S. Pat. No. 4,021,322 an indirect electrochemical oxidation of phosphorus in aqueous hydrogen halide to produce phosphorus acid.

A principal object of the invention is to produce organophosphorus compounds directly from elemental phosphorus. Another object of the invention is to produce trialkyl phosphates and thiophosphates without generating hydrogen chloride as a by-product. A further object of the invention is to produce organophosphorus compounds at ambient temperatures and pressures. Other objects of the invention will be evident to those skilled in the art from study of the description and examples below.

SUMMARY OF THE INVENTION

Surprisingly, it has been found that electrolysis of alcohols, phenols, mercaptans, and thiophenols made conductive by the presence of an inorganic salt in a cell equipped with an anode of elemental phosphorus leads to the production of organophosphorus compounds in the electrolyte. Electrolysis of alcohols produces trialkyl phosphates primarily. The product from phenols in the electrolyte is triaryl phosphates. Sulfhydryl compounds yield thioesters. Polyhydric compounds such as ethylene glycol may also be employed.

DESCRIPTION OF THE INVENTION

Elemental phosphorus exists in several molecular allotropic forms, each of which has either variously colored varieties, or different, structural types, or both.

White phosphorus is the most volatile and reactive form. It is structurally the most closely related to phosphorus liquid and vapor, $P_4$. Normally cubic, under different forcing conditions the white form can be transformed into a white hexagonal, a vitreous gray, a dark red, and a scarlet type. Upon UV irradiation at low temperature, transformation from white to brown phosphorus takes place. Cubic white can also be heated under high pressure to orthorhombic black crystals. White phosphorus melts at 44° C., hence can easily be shaped or molded to make electrodes. Most workers regard so-called yellow phosphorus as the white with small amounts of impurities such as arsenic, high-boiling aromatic compounds, phosphorus oxides, or phosphorus acids. White phosphorus is an insulator with a resistivity of about $5\times10^{10}$ ohm-cm.

Black phosphorus is a polymeric form which, upon application of increasing pressure, changes from amorphous to orthorhombic rhombohedral to cubic crystals. Black phosphorus is the most thermodynamically stable type of phosphous and the only type which is an electrical conductor with a resistivity of 1.1 ohm-cm at 11° C. and 0.6 ohm-cm at 42° C. Upon heating to 125° C. black amorphous becomes red amorphous. Black phosphorus is the most dense and least reactive form; it can be prepared from white or red only under high pressure.

Intermediate between the white and black forms in reactivity are the polymeric red forms of phosphorus. There are red amorphous, which upon recrystallization from molten lead forms a three-dimensional violet (Hittorf's) type, a tetragonal red resulting from heating amorphous red to 540° C., which in turn becomes triclinic red at 550° C. Heating amorphous red to 600° C. produces cubic red directly. The red forms are all insulators.

Brown phosphorus can be condensed from $P_2$ vapor at liquid nitrogen temperature or prepared by irradiating hexagonal white hexagonal with UV at −190° C. Brown phosphorus is also an insulator which upon heating above −100° C. becomes a mixture of red and white.

All the allotropic forms of phosphorus upon heating produce $P_4$ vapor, which starts to dissociate to $P_2$ vapor at 800° C. At 1700° C. there are approximately equal amounts of $P_4$ and $P_2$ molecules.

Although the more expensive black phosphorus is the only pure phosphorus which conducts electricity, electrodes can be made from white, yellow, or red by various techniques. For example, white, yellow, or even red in molten form can be impregnated into variously shaped porous carbon or graphitic electrodes. Additionally, phosphorus-mercury amalgams, or preferably phosphorus-silver, mercury amalgams, can serve as an anode in the present invention, most conveniently as a pool in the bottom of the cell. White or red phosphorus can be melted inside cup-shaped microporous graphite to form a heterogeneous electrode. White or red phosphorus can be smeared onto graphite rods or other shapes so that tripartite contact is made between an electrical conductor such as graphite, the anodic phosphorus, and the electrolyte. Those skilled in the art can devise other means for putting phosphorus at the electrical/electrolytic junction in order to practice the present invention.

The cathode required to practice the present invention can be any indifferent electrical conductor. Graphite is the preferred cathodic material, platinum group metals, silver, gold, copper, or aluminum may also be used for the cathode.

The cell containing the electrolyte is advantageously constructed of glass or other nonporous ceramic. Also suitable meterials of construction are plastics such as polyethylene, polypropylene, polyvinyl chloride, polyvinylidene chloride, cross-linked resins, rubbers, or other materials lined with glass, ceramic, or chemically resistant polymers. The arrangement of the electrodes in the cell is not critical for carrying out the process of the present invention. Various geometric alternatives can be used. For example, two cylindrical electrodes of different size can be placed one inside the other. Or, a straight electrode of any convenient shape can be set inside a cylindrical electrode. Alternatively, two straight, or two paddle shaped electrodes can be employed.

The electrolysis cell may be compartmented by a separator or uncompartmented without a separator. If a separator is used, it may be a microporous diffusion barrier, that is a diaphragm, such as clay, fused alumina, parchment, cellulosic film, supported water glass, or a textile of asbestos or synthetic fibers. An ionic discriminating barrier, that is a membrane, may be employed such as a synthetic ion-exchange membrane, oxidized cellulosic film, or supported gelatin.

The organic moiety for the organophosphorus compounds produced by the process of the present invention can be supplied by hydroxyl compounds, to make organic phosphates, or sulfhydryl compounds, to make thiophosphates. The hydroxyl compounds can be alcohols, glycols, or phenols. The sulfhydryl compounds can be mercaptans or thiophenols.

Among the alcohols which can be employed in the electrolyte of the present invention to make trialkyl phosphates are the saturated alcohols having 1 to 12 carbon atoms. Among these are methyl, ethyl, isopropyl, propyl, butyl, isobutyl, sec-butyl, amyl, isoamyl, hexyl, cyclohexyl, octyl, capryl, decyl, and lauryl alcohol. Ethylene glycol, 1,2-propanediol, trimethylene glycol, or the butanediols may also be employed as electrolytes.

Among the phenols which can be employed in the electrolyte to make triaryl phosphates are phenol, the cresols, chlorophenols, nitrophenols, bromophenols, and the cyclohexyl phenols. For those phenols which are solids a liquid electrolyte can be formed by adding an indifferent liquid solvent such as a low-boiling alkane or a liquid aromatic hydrocarbon.

As a source of organosulfur moieties to produce organic thiophosphates mercaptans such as methyl, ethyl, propyl, butyl, amyl, hexyl, mercaptan and their isomers may be employed in the electrolyte in practicing the present invention. Aromatic sulfhydryl groups for producing aryl thiophosphates may be supplied by thiophenol, thiocresols, or cyclohexylthiophenol.

The compounds listed above are suggestive of the hydroxyl or sulfhydryl compounds which may be employed in practicing the electrolysis of the present and are not intended to be limiting.

As a source of direct current for the electrolysis a battery or rectifier may be employed. The voltage impressed should be sufficient to electrolyze the hydroxyl or sulhydryl compound and can range from about 5 volts to about 50 volts, with about 15 volts to about 25 volts preferred. The area of the electrodes, the salt content of the electrolyte, the cell, and the impressed voltage should be so chosen that the current density varies from about 0.01 amp/cm$^2$ to about 0.5 amp/cm$^2$, with about 0.05 amp/cm$^2$ to about 0.2 amp/cm$^2$ preferred.

In order to make the hydroxyl or sulfhydryl compound ionically conductive, an indifferent ionizable salt should be added to the electrolyte. For this purpose the nonreactive salts of an alkali metal or ammonium cation are preferred. Alkyl-substituted ammonium cations are especially preferred. Halogen, nitrate, bicarbonate, bisulfate, sulfate, or p-toluene sulfonate anions are preferred. Tetraethylammonium p-toluene sulfonate is especially preferred as an ion-conductivity agent in the electrolyte.

The examples below illustrate the present invention. Those skilled in the art of organic electrochemistry may conceive of other illustrative alternative modes for practicing this invention which would still be within the scope of this disclosure.

EXAMPLE 1

This Example illustrates the preparation of an organic phosphate ester directly from phosphorus and the alcohol.

A cylindrical, jacketed, glass cell 18 cm high and 4 cm in diameter was fitted with a hemispherical ground glass joint having a number 50 O-ring. Passages through the cap were constructed for nitrogen entrance and gas outlet. An aluminum strip through the cap ran down into the solution as a cathode. A pool of mercury/yellow white phosphorus on the bottom served as the anode, also containing a stirrer bar. A platinum wire from the anode pool through the cell connected the anode to a rectifier power supply. (R. O. Hull Co., Model B-1000, Cleveland, Ohio).

As an electrolyte 2 g. tetrabutylammonium fluoroborate was dissolved in 40 ml. anhydrous ethanol. After nitrogen purging the electrolysis was run with magnetic stirring for 19 hours with 10–15 v. D.C. applied to give a current of 0.06–0.1 a.

After separating the clear liquid from the grey-black solids, it was analyzed by infrared spectroscopy and gas chromatography showing that some triethyl phosphate had formed.

EXAMPLE 2

This Example repeated the method of Example 1 except for different electrodes.

An anode of phosphorus was made by pouring yellow white phosphorus into a hollow, cylindrical, porous, graphite cup 14 mm long and 6 mm in outer diameter (4 mm inner diameter) from Ultra Carbon Corp. (Bay City, Michigan) number 623603, grade U-20, purity level F. The cathode was a graphite rod 8 cm long and 6 mm in diameter, National Carbon Co. (Cleveland, Ohio).

The electrolyte was 2.5 g. tetraethylammonium p-toluene-sulfonate in 35 ml anhydrous ethanol. Ten volts was applied for 53 hours at 52° C. giving a current flow of 0.12 a.

Gas chromatographic and $^{31}P$ nmr showed that triethyl phosphate plus lesser amounts of another unidentified organophosphorus compound formed in the electrolyte during the electrolysis.

EXAMPLE 3

Using the same apparatus and procedures of Example 2 a similar preparation was run with a porous carbon anode containing 0.82 g. yellow white phosphorus. The electrolyte was 2 g. tetraethylammonium chloride in 35 ml anhydrous ethanol. At 55° C. 4.5 v. was impressed across the cell for 53 hours giving a current of 0.1 a under nitrogen. The weight loss of phosphorus was 0.32 g.

The undistilled reaction liquor was analyzed by gas chromatography and $^{31}P$ nmr indicating three products: triethyl phosphate, triethyl phosphite, and a lower boiling material which may be 2-chloroacetethoxy acetal.

EXAMPLE 4

This Example illustrates preparation of a trialkyl phosphate from an alcohol and elemental phosphorus utilizing an apparatus different from that in the previous Examples.

A cylindrical jacketed electrolysis cell was constructed of glass 8 cm in diameter and 20 cm high. The jacket had an inlet and outlet for the circulating water used to control the temperature. Approximately 15 cm from the bottom was a fitting for a reflux condenser. A hemispherical glass top was mounted on the electrolysis cell by means of a ground glass joint fitted with a number 50, rubber O-ring, through which copper wires connecting to the electrodes were run. Also the top bore an inlet for nitrogen gas. Metal clips held the electrodes suspended from the copper wire leads. A magnetic stirring bar was placed in the bottom of the cell which normally held 350 ml of electrolyte. A direct current rectifier (R. O. Hull, Model B-1000, Cleveland, Ohio) was the source of power. The cathode was a cylindrical piece of carbon with a 5 cm outside diameter, 4 cm inside diameter, 4 cm high. The anode was a porous graphite cup holding 6.1 g. yellow white phosphorus with an outside diameter 2.5 cm, an inside diameter 2 cm, 3 cm high. The anodic cup was supported in the cylindrical cathode by four "pegs" of TEFLON fluorocarbon polymeric tubing 0.5 cm in diameter by holes drilled through the cathode.

The electrolyte consisted of 7.2 g. tetramethylammonium chloride in 150 ml anhydrous ethanol. With 3–5 v. DC impressed for 163 hours the electrolysis was carried out at 55° C. with a current of 0.08–0.6 a.

Gas chromatographic analysis of the reaction liquor showed five principal organic products in addition to ethanol. One of the products was identified as triethyl phosphate.

EXAMPLE 5

This Example illustrates a preparation similar to that of Example 4, in the same apparatus, but employing a different electrolyte.

An electrolyte composed of 18.6 g. tetraethylammonium p-toluenesulfonate in 150 ml anhydrous ethanol was placed in the same electrolysis cell as used in Example 4. The anode contained 4.7 g. yellow white phosphorus in the graphite cup. Applying 3–6 v. for 163 hours at 55° C. gave 0.09–0.6/a current.

Gas chromatographic analysis showed that triethyl phosphate had formed in the reaction liquor.

EXAMPLE 6

This Example illustrates the use of crystalline black phosphorus as an anode in the process of the present invention.

The electrolysis cell employed in Example 1 was used but with different electrodes suspended from copper lead wires. The cathode was a graphite rod 8 cm long and 6 mm in diameter. The anode was a monolithic piece of black phosphorus obtained from the Reidel-Hoen A.G. (Seelze-Hannover, West Germany) weighing 0.52 g.

The electrolyte was 2.9 g. tetramethylammonium chloride in 60 ml anhydrous ethanol. The electrolysis was carried out at 35° C. for 88 hours at 6.5 v. to give 0.1 a current. Gas chromatographic analysis of the red-brown reaction liquor showed that both triethyl phosphate and triethyl phosphite were formed.

In like manner to the above, an electrolysis was carried out at 45° C. with the same electrodes, the same electrolyte, for 64 hours, with 11 v. D.C. impressed, and 0.2 a current.

Another electrolysis was carried out with the same electrolyte at 38° C. employing a piece of monolithic black phosphorus from the American Hoechst Co. (Somerville, N.J.) weighing 0.34 g. at 15 v. D.C. and 0.16 a current.

COMPARATIVE EXAMPLE 7

This Example describes two kinds of control experiments to show that electrolysis at a phosphorus anode is crucial to the practice of the present invention. In experiment 7A no electrolysis took place. In experiment 7B no phosphorus was employed.

In the electrolysis cell used in Example 5 an electrolyte of 4.8 g. tetramethylammonium chloride in 100 ml anhydrous ethanol was stirred overnight at 55° C. under nitrogen with 6.4 g. of yellow white phosphorus in the porous cup anode. No current was passed. Gas chromatographic analysis showed no sign of an organophosphorus compound.

A similar electrolysis was run at 55° C. in the same electrolyte as above for 21 hours at 18 volts and 0.3 a current, but no phosphorus was in the anodic graphite cup. Gas chromatographic analysis showed the formation of three different ethoxy compounds, but none of them contained any phosphorus.

We claim:

1. A process for the preparation of organophosphorus derivatives of organic hydroxyl or sulfhydryl compounds which includes the step of electrolyzing said organic hydroxyl or sulfhydryl compounds in an electrochemical cell having an anode comprising elemental phosphorus.

2. The process of claim 1 wherein the organic hydroxyl compound is an alcohol.

3. The process of claim 2 wherein the alcohol is ethanol.

4. The process of claim 2 wherein the alcohol is a propanol.

5. The process of claim 2 wherein the alcohol is a butanol.

6. The process of claim 1 wherein the organic hydroxyl compound is a glycol.

7. The process of claim 1 wherein the organic hydroxyl compound is a phenol.

8. The process of claim 1 wherein the organic sulfhydryl compound is a mercaptan.

9. The process of claim 1 wherein the organic sulfhydryl compound is a thiophenol.

10. The process of claim 1 wherein the elemental phosphorus is in a form known as white phosphorus.

11. The process of claim 1 wherein the elemental phosphorus is in a form known as yellow phosphorus.

12. The process of claim 1 wherein the elemental phosphorus is in a form known as red phosphorus.

13. The process of claim 1 wherein the elemental phosphorus is in a form known as black phosphorus.

* * * * *